US009509090B2

(12) United States Patent
Cichonski

(10) Patent No.: US 9,509,090 B2
(45) Date of Patent: Nov. 29, 2016

(54) PLUG COMPRISING AN INTERNAL PULLOUT MECHANISM

(71) Applicant: ADVANCED DIGITAL BROADCAST S.A., Geneva (CH)

(72) Inventor: Dariusz Cichonski, Zielona Gora (PL)

(73) Assignee: ADVANCED DIGITAL BROADCAST S.A., Chambesy (CH)

( * ) Notice: Subject to any disclaimer, the term of this patent is extended or adjusted under 35 U.S.C. 154(b) by 0 days.

(21) Appl. No.: 15/018,873

(22) Filed: Feb. 9, 2016

(65) Prior Publication Data

US 2016/0240968 A1 Aug. 18, 2016

(30) Foreign Application Priority Data

Feb. 17, 2015 (EP) ..... 15155316

(51) Int. Cl.

| | |
|---|---|
| ***H01R 13/62*** | (2006.01) |
| ***H01R 13/629*** | (2006.01) |
| ***H01R 13/633*** | (2006.01) |
| ***H01R 24/30*** | (2011.01) |
| *H01R 103/00* | (2006.01) |

(52) U.S. Cl.

CPC .. *H01R 13/62933* (2013.01); *H01R 13/62938* (2013.01); *H01R 13/633* (2013.01); *H01R 24/30* (2013.01); *H01R 2103/00* (2013.01)

(58) Field of Classification Search

CPC ..... H01R 13/629; H01R 13/62905; H01R 13/62933; H01R 13/62938; H01R 13/62977

USPC ..... 439/152, 157, 159, 160

See application file for complete search history.

(56) References Cited

U.S. PATENT DOCUMENTS

| | | | | |
|---|---|---|---|---|
| 2,696,594 A | | 12/1954 | Harrington | |
| 4,114,969 A | | 9/1978 | Borg | |
| 5,281,157 A | * | 1/1994 | Abe | G06K 7/0047 439/159 |
| 5,518,413 A | * | 5/1996 | Taniuchi | H01R 13/62933 439/157 |
| 6,033,242 A | * | 3/2000 | Oguchi | G06K 7/0047 439/159 |
| 6,071,133 A | * | 6/2000 | Ho | G06K 13/08 439/159 |
| 6,716,044 B2 | * | 4/2004 | Bertke | H01R 13/6335 439/159 |
| 7,344,393 B2 | * | 3/2008 | Buller | H01R 13/635 439/152 |
| 2011/0151695 A1 | * | 6/2011 | Yang | H01R 12/7094 439/159 |
| 2015/0011106 A1 | * | 1/2015 | Kamiya | H01R 13/62955 439/157 |
| 2015/0249305 A1 | * | 9/2015 | Toratani | H01R 13/639 439/357 |

FOREIGN PATENT DOCUMENTS

| | | |
|---|---|---|
| CN | 102025081 A | 4/2011 |
| JP | 2003257549 A | 9/2003 |

* cited by examiner

*Primary Examiner* — Chandrika Prasad
(74) *Attorney, Agent, or Firm* — Mark M. Friedman

(57) ABSTRACT

A plug comprising: a housing (210); an ejector (220); an inner core (230) comprising at least two pins (232); wherein: the inner core (230) is slidably mounted within the ejector (220) while the ejector (220) is slidably mounted in the housing (210); the housing (210) comprises a fixedly mounted first bracket (211) configured to guide a first end of a lever (240); the ejector (220) comprises a fixedly mounted second bracket (221) configured to guide a second end of the lever (240); the lever (240) has a middle mounting element (242B), shifted from the center of the lever (240) towards one of its ends, configured to guide a rod (243) attached to the inner core (230); wherein the lever (240) is configured within the housing (210) such that when the ejector (220) slides out of the housing (210) to a first extent, due to the movement of the lever (240), the inner core (230) slides within the ejector (220) to a second extent, which is lower than the first extent.

11 Claims, 16 Drawing Sheets

PLUG COMPRISING AN INTERNAL PULLOUT MECHANISM

The present invention relates to a plug comprising a pullout mechanism. In particular the present invention relates to an electrical plug comprising an internal pullout mechanism.

Prior art defines a publication of U.S. Pat. No. 7,344,393 B2 entitled "Electric plug comprising a plug housing and at least two integrated plug-in contacts with an ejection mechanism" that discloses an electric plug including a plug housing, at least two incorporated plug-in contacts that are to be inserted into corresponding jacks of an outlet, and a cable feeder. A manually actuated ejection mechanism encompassing a push-out device is disposed in the plug housing. The push out device cooperates with a spring in such a way that the spring is biased in the plugged-in state of the plug in order to allow the plug to be automatically removed from the outlet by means of the push-out device when the ejection mechanism is actuated. In order to actuate the ejection mechanism, the same is automatically triggered by pulling on the cable, the tensile force being effective on a strain relief device for the cable, which is located in the plug housing and cooperates with triggering device for actuating the spring-biased push-out device.

A drawback of this solution is a complicated spring mechanism that makes its production more expensive and decreases reliability.

Another known publication U.S. Pat. No. 6,716,044 B2 entitled "Ejectable electrical connector and method of use" discloses a device and method for separating electrical connector assemblies. Separation of an electrical connector assembly is accomplished by at least one lever disposed in the body of at least one of the connectors. The lever is attached to the body of the connector such that when the lever is "up" the lower portion of the lever is flush with the mating surface so as not to not interfere with the coupling of the connector. Actuation of the lever, i.e., moving the lever to its down position, causes a displacement of at least one of the connectors comprising the electrical connector assembly.

A further prior art publication U.S. Pat. No. 2,051,425 A entitled "Electric plug" discloses a pair of substantially L-shaped levers are fulcrumed in the diametrically opposite ears of plug body on suitable pins. Outer arms of the levers are suitably shaped so as to provide a good finger grip. When it is desired to disconnect the plug from its socket, outer arms are forced radially inwardly by a slight. pressure of the fingers, thereby rocking levers about fulcrum pins and quickly ejecting the plug from its socket due to the abutting engagement of inner arms with the face of socket.

A drawback of these solutions is a lever protruding externally from the electric plug. This is inconvenient for users, while additionally causing problems with applying equal force at different portions of the socket while ejecting the plug from a socket.

Yet another prior art publication RU 2492561 discloses an ejector, which consists of a nosepiece and a housing. The nosepiece sits on the housing of the plug. When a small lever is pressed, the housing of the ejector rotates around the nosepiece and, while resting on side members in the housing of the socket, draws the plug from the socket.

Similarly, a drawback of this solution is a lever protruding externally from the electric plug. This is inconvenient for users, while additionally causing difficulties with applying equal force at different portions of an electric socket while ejecting the plug.

A further drawback is that the aforementioned, known solution requires to directly operate an additional mechanism by a user i.e. to change users' approach to typical unplugging.

It would be therefore advantageous to improve the pullout mechanism so that it is fully internal to the plug so that there are not required any additional actions or moves from a user. Further, it is an aim of the present invention to limit a force required in order to pull the plug out of a socket while also eliminating a force pulling a socket out of the wall mounting when a typical plug is pulled out of the socket.

The aim of the development of the present invention is therefore an improved plug pullout mechanism.

SUMMARY AND OBJECTS OF THE PRESENT INVENTION

An object of the present invention is a plug comprising: a housing; an ejector; an inner core comprising at least two pins; wherein: the inner core is slidably mounted within the ejector while the ejector is slidably mounted in the housing; the housing comprises a fixedly mounted first bracket configured to guide a first end of a lever; the ejector comprises a fixedly mounted second bracket configured to guide a second end of the lever; the lever has a middle mounting element, located between the first end of the lever and the second end of the lever, configured to guide a rod attached to the inner core; wherein the lever is configured within the housing such that when the ejector slides out of the housing to a first extent, due to the movement of the lever, the inner core slides within the ejector to a second extent, which is lower than the first extent; and wherein the mechanical advantage of the lever is greater than 1.

Preferably, the middle mounting element is shifted from the center of the lever towards one of its ends.

Preferably, the at least two pins are male pins and in that the inner core comprises a third female pin.

Preferably, the mounting positions of the first and second brackets and the size of the ejector are such that when the plug's pins are fully inserted in socket's contacts, the lever is perpendicular to the plug's pins.

Preferably, the first bracket is fixedly mounted to the housing at a fixed position and the second bracket is fixedly mounted to the ejector such that it moves slidably with it.

Preferably, the inner core is slidably mounted within the ejector in at least one guide preventing the inner core from rotatably moving within the ejector.

Preferably, the plug comprises a threaded portion for mounting a plug's cap comprising an opening for receiving an electrical cord.

Advantageously, the housing and the ejector as well as the inner core and the ejector are in proximity to each other so that there is avoided side shake and there is allowed a gap between these elements is in the range allowing for a clearance fit.

Preferably, the rod, the lever, and the brackets are made from a rigid material.

Preferably, the lever is connected to a lever lock such that the locked lever is mounted to the first bracket, the second bracket and the rod.

Preferably, the first bracket and the second bracket comprise an elongated opening, extending perpendicularly to the plug's pins.

BRIEF DESCRIPTION OF THE FIGURES

These and other objects of the invention presented herein, are accomplished by providing a plug comprising a pullout mechanism. Further details and features of the present invention, its nature and various advantages will become more apparent from the following detailed description of the preferred embodiments shown in a drawing, in which.

DESCRIPTION OF EMBODIMENTS

Figure 1:
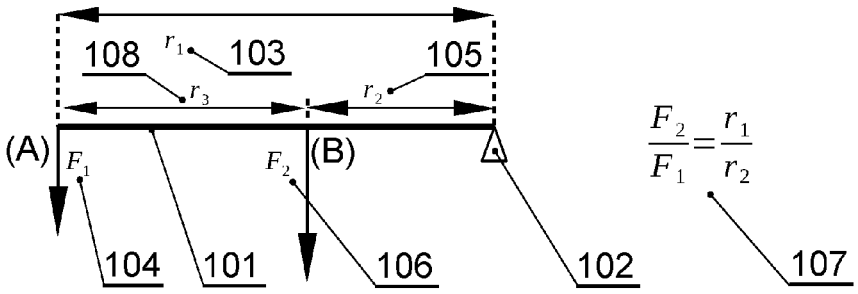
Fig. 1 (Prior Art)
FIG. 1 presents details of a known lever principle.

FIG. 1 presents details of a known lever principle. A lever is a machine comprises a rigid rod (101) pivoted at a fixed hinge, or fulcrum (102). It is one of the six simple machines. A lever amplifies an input force to provide a greater output force, which is said to provide leverage. The ratio of the output force to the input force is the mechanical advantage of the lever.

A particular kind of lever is "Resistance in the middle" type, wherein the effort is applied on one side of the resistance, and the fulcrum (102) is located on the other side. This kind of levers is sometimes referred to as Class 2 levers.

If the rigid rod (101) is split into two uneven sections (105, 108) whereby $r_1$ (103) is a length of the rigid rod (101) and $r_2$ (105) is the length of the shorter of the two sections ($r_2<r_3$), then a force $F_1$ (104) applied to point (A) is the input and the force $F_2$ (106) applied at point (B) is the output, the ratio of the lever is given by $r_1/r_2$ (107).

Figure 2:
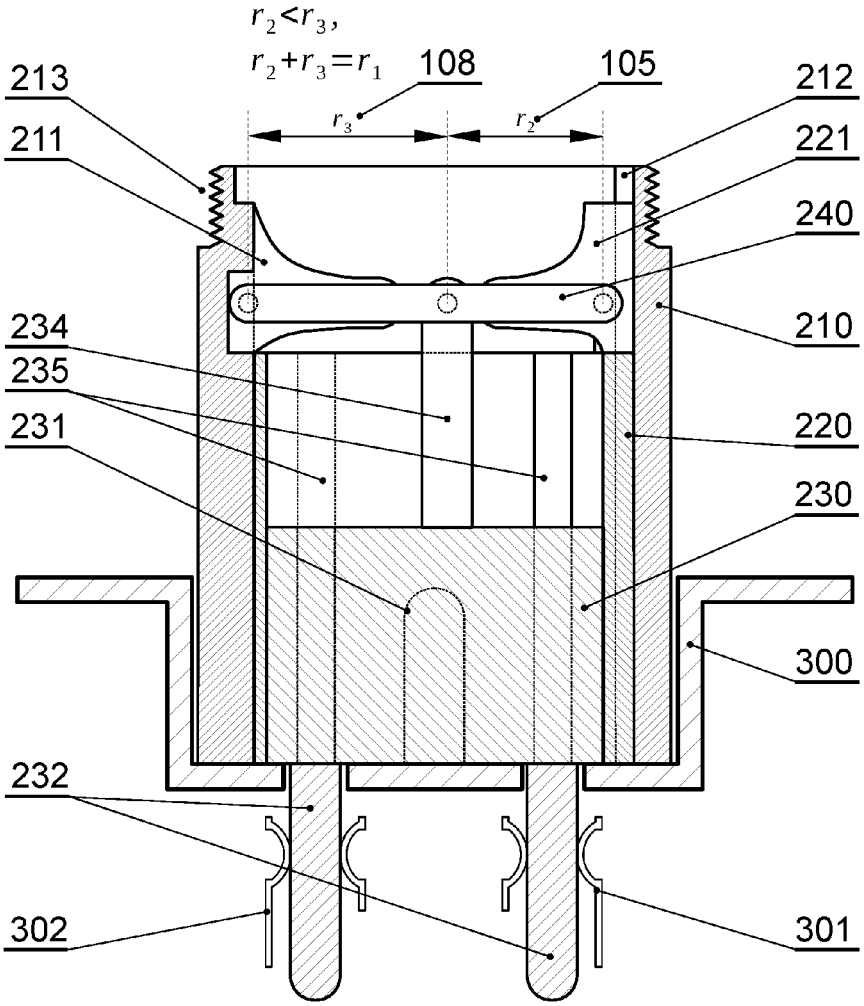
FIG. 2 shows a cross-section of a plug, according to the present invention, inserted in a socket.

FIG. 2 shows a cross-section of a plug, according to the present invention, inserted in a typical electric socket. The plug is preferably of cylindrical, or substantially cylindrical or cylinder-like shape. Nevertheless, other shapes of a plug are possible in other embodiments, in particular a cuboid.

The socket comprises a typical housing (300) as well as at least two socket contacts (301, 302) arranged to receive at least two a plug's pins (232 pair) respectively. The contacts (301, 302) are sometimes referred to as socket terminals.

The plug, according to the present invention, comprises a housing (210) whereas the housing (210) comprises an inner ejector (220) slidably mounted within the housing (210). The extent of the sliding movement will be defined by the length of a lever (240) and shape/positioning of a first bracket (211) and a second bracket (221). Details of the first bracket (211) and a second bracket (221) as well as the lever (240) will be provided in relation to the subsequent figures.

The mounting positions of the first (211) and second (221) brackets and the size of the ejector (220) are preferably such that when the plug's pins (232) are fully inserted in a socket, the lever (240) is perpendicular to the plug's pins (232). The aforementioned perpendicular position of the lever (240) may further by facilitated by a use of a stop (212).

The first bracket (211) is fixedly mounted to the housing (210) at a fixed position and is preferably not movable. The second bracket (221) is fixedly mounted to the ejector (220), so that it moves slidably with it.

The ejector (220) comprises an inner core (230), with at least two pins (232), slidably mounted within the ejector (220). The extent of the sliding movement will be defined by the length of a rod (234) of the lever (240.

The inner core (230) may be slidably mounted within the ejector (220) in at least one guide (shown in more details in the subsequent figures) (235) preventing the inner core (230) from rotatably moving within the ejector (220).

Lengthwise, preferably the housing (210) is the longest, while the ejector (220) is shorter than the housing (210) and the inner core (230) being shorter that the ejector (220). Preferably, in one embodiment of the plug, the housing (210) has a length of 47 mm, the ejector (220) has a length of 45 mm while the inner core (230) has a length of 19 mm (excluding the pins (232)).

The rod (234) connects the inner core (230) with the lever (240), preferably at a position such that the distance $r_3$ (108) is greater that the $r_2$ distance (105) (in an alternative embodiment $r_3$ may equal $r_2$). The connection between the rod (234) and the core (230) may be shifted from the center of the circumference of the inner core (230). Further, the lever (240) is preferably positioned on (or in proximity to) the geometrical diameter of the housing (210). The rod (234) is preferably parallel to the housing's (210) sidewalls or to the pins (232).

The location of the rod (234) adjusts the mechanical advantage of the lever thereby influencing a level of a required force to pull out the plug. The higher the ratio $r_3/r_1$ the lower the pulling-out force, according to the equation of FIG. 1. With the increase of $r_3/r_1$, the movement of the housing (210) increases, eg. for $r_3/r_1=0.5$ there is a two times reduction of the force with a two times increase of the movement of the housing (210).

The sliding relation of the housing (210), the ejector (220) and the inner core (230) is such that when the housing (210) is pulled out away from the socket, to a first extent, the ejector (220) remains unmoved, due to the movement of the lever (240) and the inner core (230) slides within the ejector (220) to a second extent, which is lower than the first extent. The directions of movement of the housing (210) and the inner core (230) are the same. The relation between the first extent and the second extent has been shown in more details in FIGS. 10 and 11.

The plug may further comprise one or more female, ground contact(s) (231) located in the inner core (230). Plugs and sockets sometimes combine male and female contacts, but the exposed pins or terminals in the socket are not energized (eg. German CEE 7/4 plug and socket, French CEE 7/5 socket).

Optionally, the plug may comprise a threaded portion (213) for mounting a plug's cap comprising an opening for receiving an electrical cord.

The inner core (230) also comprises means for connecting (not shown) appropriate wires to the pins (232) as well as optionally to the ground contact(s) (231).

Naturally, the housing (210), the ejector (220) as well as the inner core (230) are preferably of cylindrical, substantially cylindrical or cylinder-like shape. Advantageously, the housing (210) and the ejector (220) as well as the inner core (230) and the ejector (220) are in proximity to each other so that there is not present any excessive side shake due to a too loose fitting of the respective elements. A preferred gap between these elements is in the range allowing for a clearance fit.

Preferably, the rod (234), the lever (240), and the brackets (211, 221) are made from a rigid material such as metal or metal alloy. Advantageously, such materials do not cause excessive friction and facilitate the sliding movements, preferably without a need to provide a lubricant. Nevertheless, solutions applying lubricants are also possible in alternative embodiments.

Figure 3A:
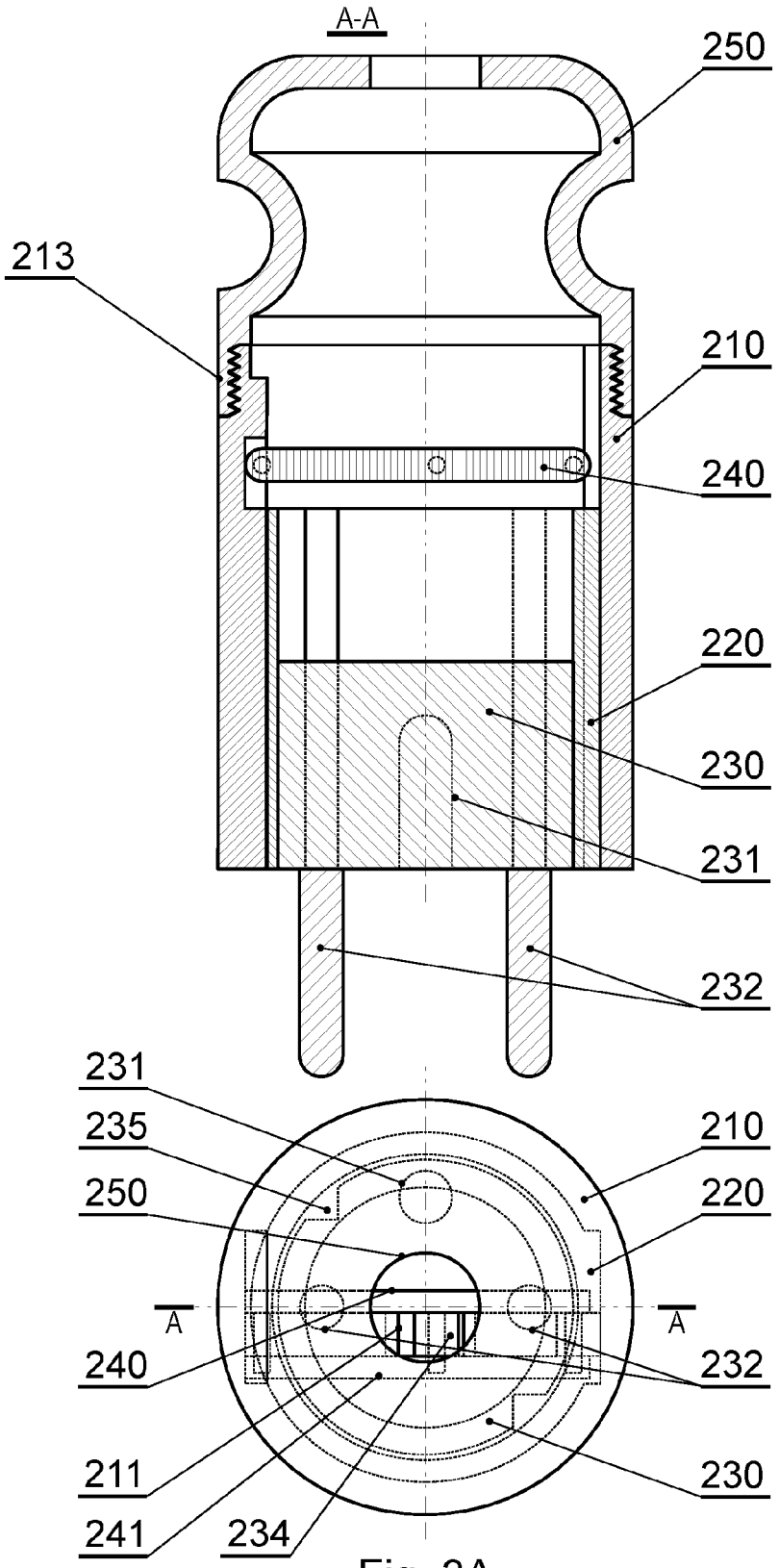
FIG. 3A depicts a first top view of the plug as well as it's A-A cross-section.

FIG. 3A depicts a top view of the plug as well as it's A-A cross-section. The plug comprises a cap (250) screwed onto the housing (210) using the threaded portion (213). It will be evident, to a person skilled in the art, that a different locking mechanism, than a thread, may be applied eg. a snap-on.

As may be readily seen, the inner core (230) is slidably mounted within the ejector (220) in two guides (235) preventing the inner core (230) from rotatably moving within the ejector (220). The guides (235) may extent along the length of the ejector (220) wherein the inner core (230) comprises appropriate cut-out portions matching the guides (235).

Figure 3B:
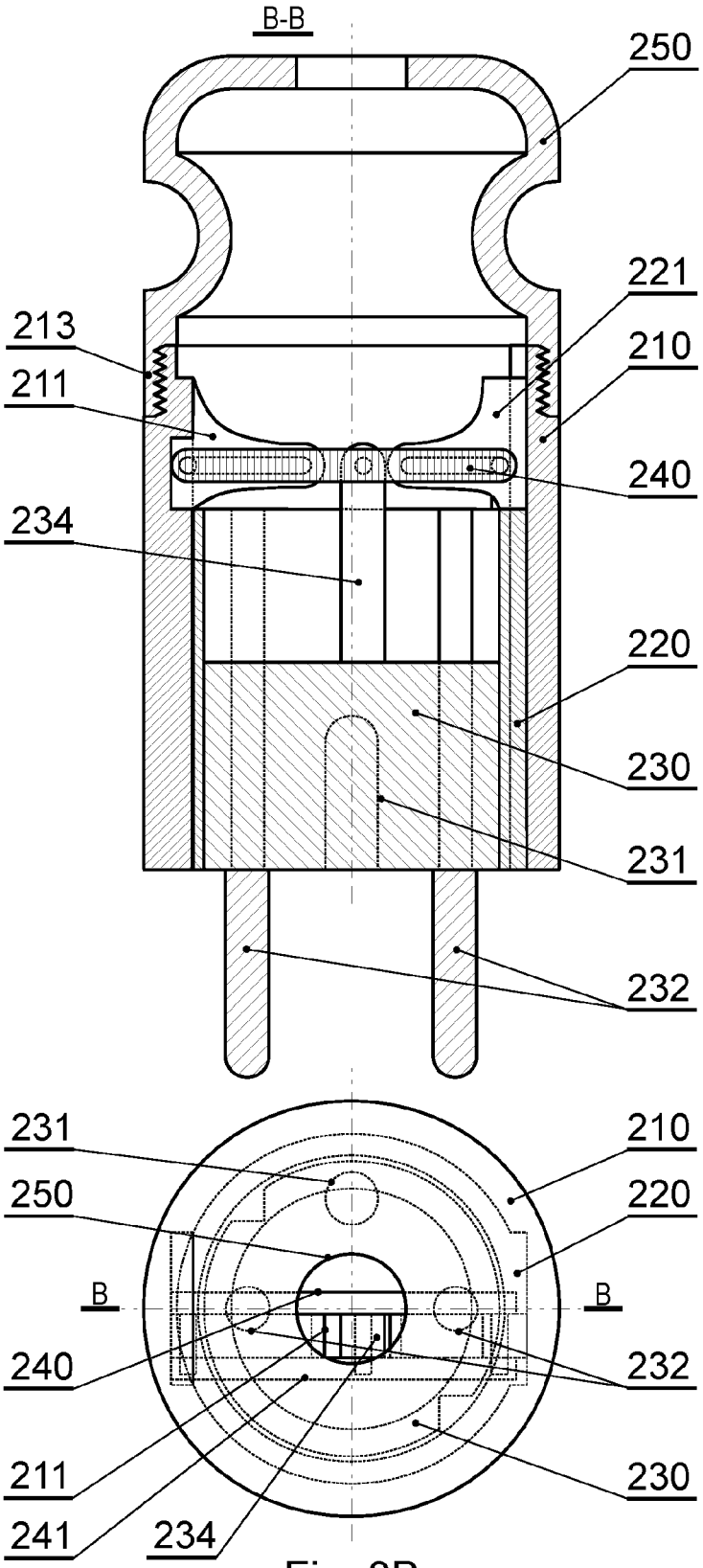
FIG. 3B presents a second top view of the plug as well as its B-B cross-section.

FIG. 3B presents a top view of the plug as well as its B-B cross-section. This view further depicts the brackets (211, 221) and the rod (234) in relation to the lever (240).

The lever (240) is connected to a lever lock (241) so that the locked lever (240) is mounted to the first bracket (211), the second bracket (221) and finally to the rod (234).

Figure 4A:
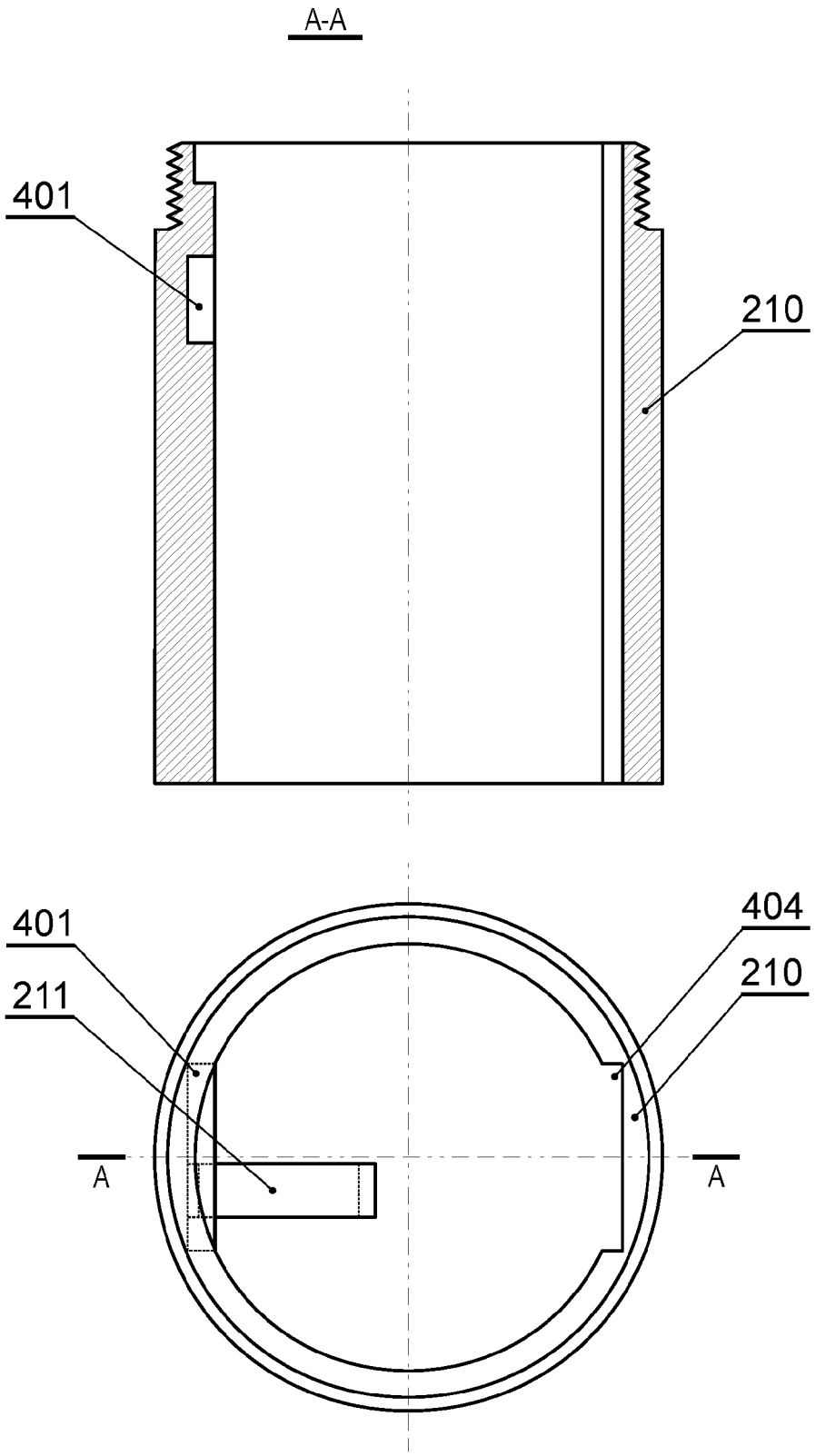
FIG. 4A shows first a top view of a housing of the plug as well as it's A-A cross-section.

FIG. 4A shows a first top view of the housing (210) of the plug as well as it's A-A cross-section. The housing (210) comprises a recess (401) configured to receive the first bracket (211) in order to fixedly mount it in the housing (210).

Figure 4B:
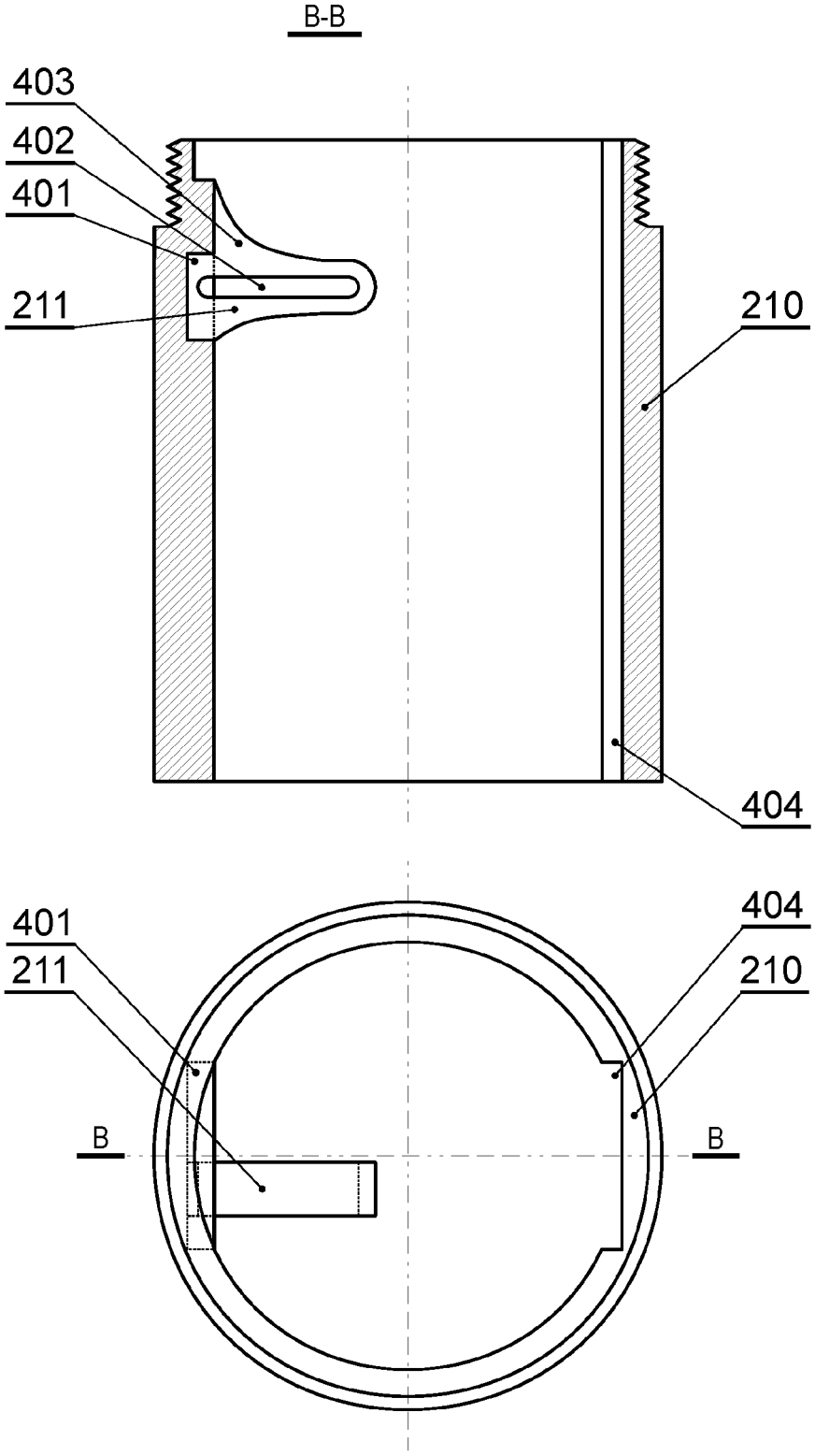
FIG. 4B shows a second top view of the housing of the plug as well as its B-B cross-section.

FIG. 4B shows a second top view of the housing (210) of the plug as well as its B-B cross-section. This is a view of FIG. 4A enhanced with a first bracket (211) mounted in the housing (210). The first bracket (211) comprises an elongated opening (402), extending perpendicularly to the plug's pins (232). Preferably, the first bracket (211) comprises a protrusion (403) configured to improve resistance to forces, present when the lever (240) returns to its initial, perpendicular position with respect to the plug's pins (232). The protrusion (403) is preferably located adjacent the housing's (210) inner wall and is directed away from the plug's ejector (220).

Similarly, the housing (210) comprises a hollow portion and a recess (404) configured to receive the ejector (220) with the second bracket (221) in order to fixedly mount the ejector (220) it in the housing (210).

Figure 5A:
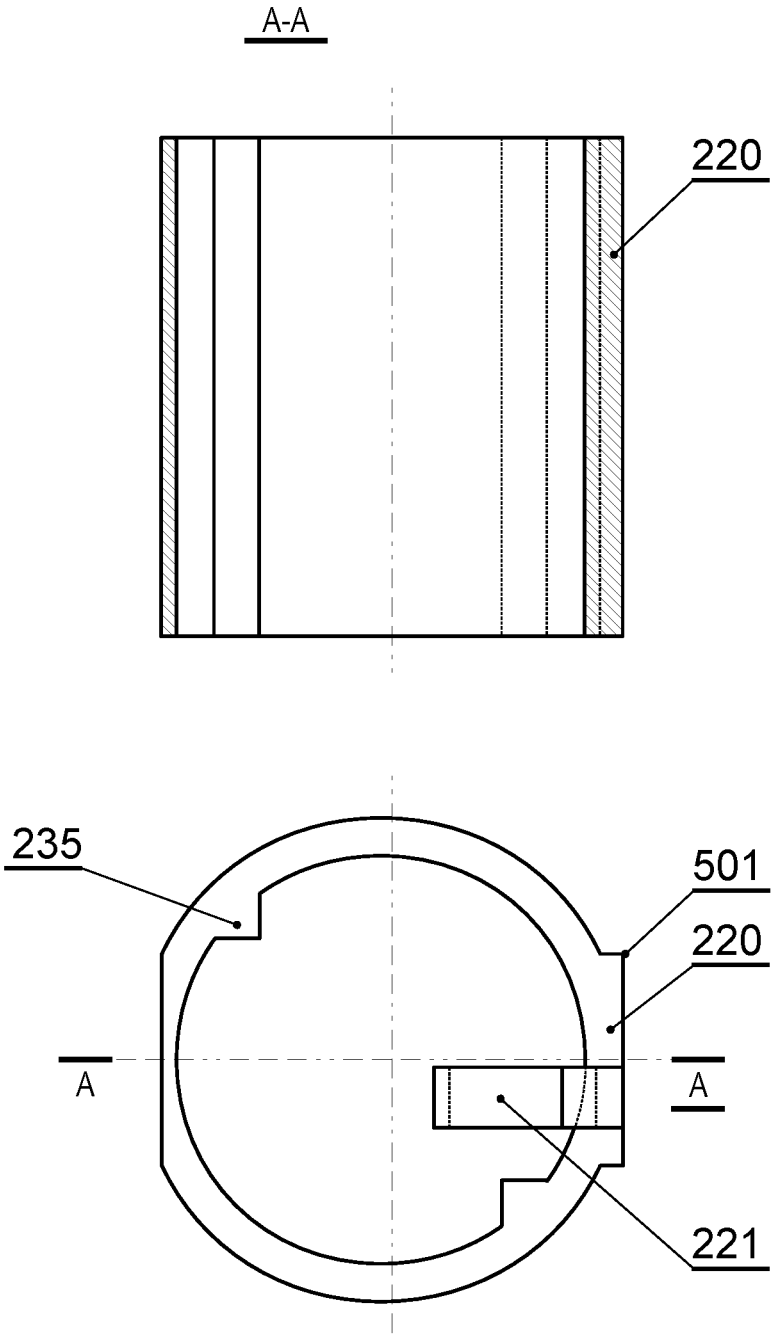
FIG. 5A shows a first top view of an ejector as well as it's A-A cross-section.

FIG. 5A shows a top view of an ejector (220) as well as it's A-A cross-section. As already explained, the ejector (220) preferably comprises at least one guide (235) for the inner core (230). Further it comprises a protrusion (501) that corresponds to the recess (404) of the housing (210).

Figure 5B:
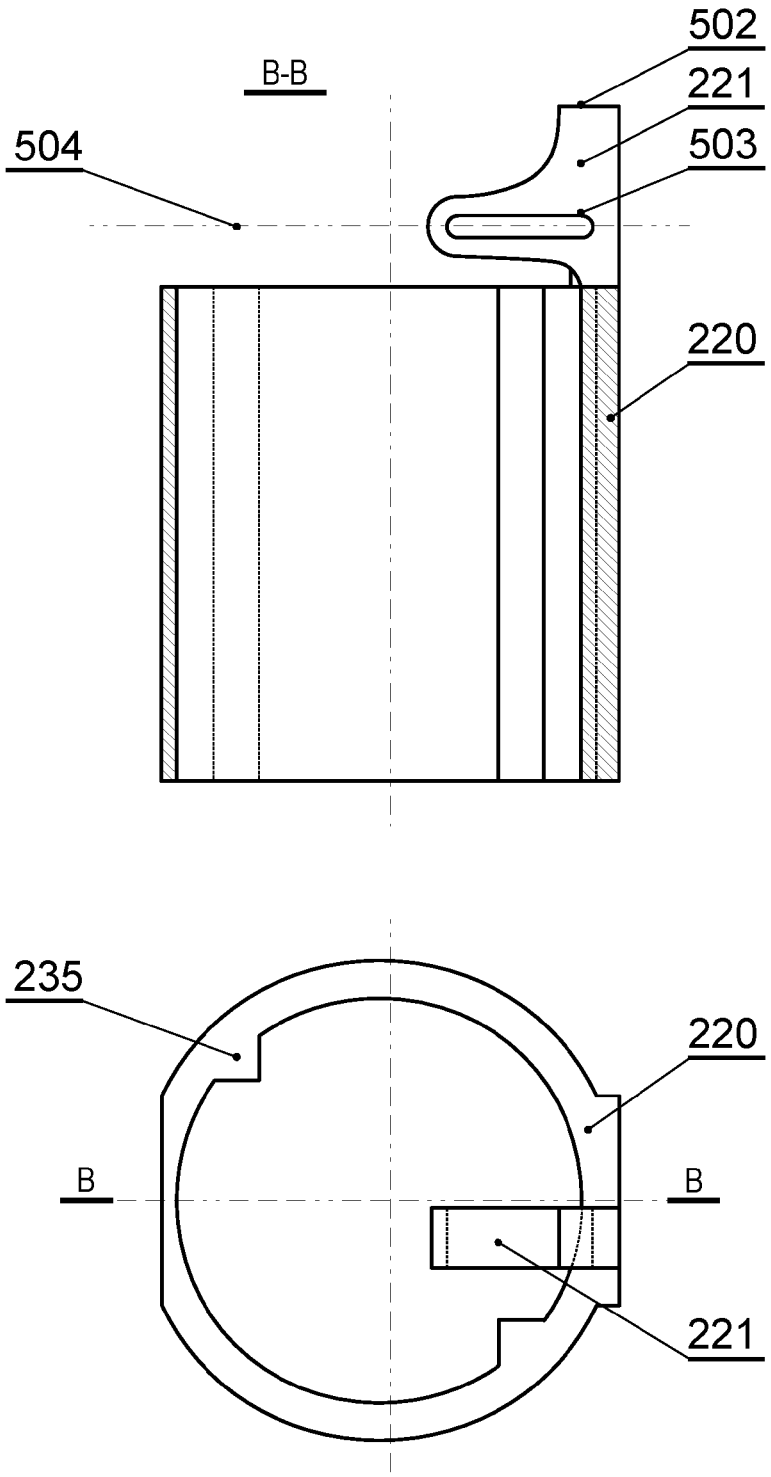
FIG. 5B depicts a second top view of the ejector as well as its B-B cross-section.

FIG. 5B depicts a top view of the ejector as well as its B-B cross-section. This is a view of FIG. 5A enhanced with the second bracket (221) mounted on the ejector (220). The second bracket (221) comprises an elongated opening (503) extending perpendicularly to the plug's pins (232). Preferably, the second bracket (221) comprises a protrusion (502) configured to improve resistance to forces, present when the lever (240) returns to its initial, perpendicular position with respect to the plug's pins (232). The protrusion (502) is preferably located adjacent the housing's (210) inner wall and is directed away from the ejector (220), preferably to engage the stop (212) shown in FIG. 1.

The inner, hollow portion of the ejector (220) is configured to slidably receive the inner core (230).

Further, the length (i.e. the greatest diameter) of the elongated opening (402) of the first bracket (211) and the elongated opening (503) of the second bracket, (221) are preferably positioned on a single axis (504), when the plug remains in its closed position. Both elongated openings (402, 503) are preferably positioned in the same geometrical plane.

Figure 6A:
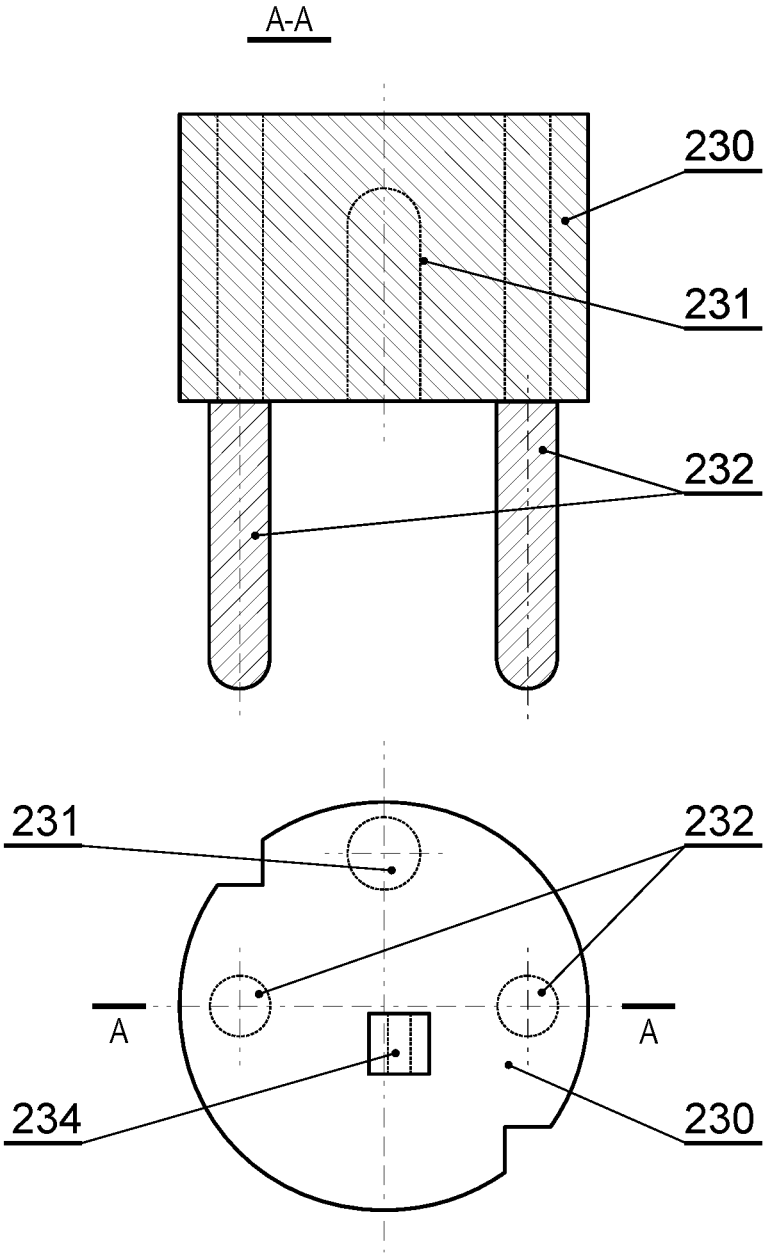
FIG. 6A presents a first top view of a core having pins as well as the core's A-A cross-section.

FIG. 6A presents a first top view of a core having pins as well as the core's A-A cross-section. The inner core (230) is a fixture comprising at least two pins in case of an electrical plug but alternatively may comprise only one pin. There is also provided a suitable mounting point for the rod (234).

Figure 6B:
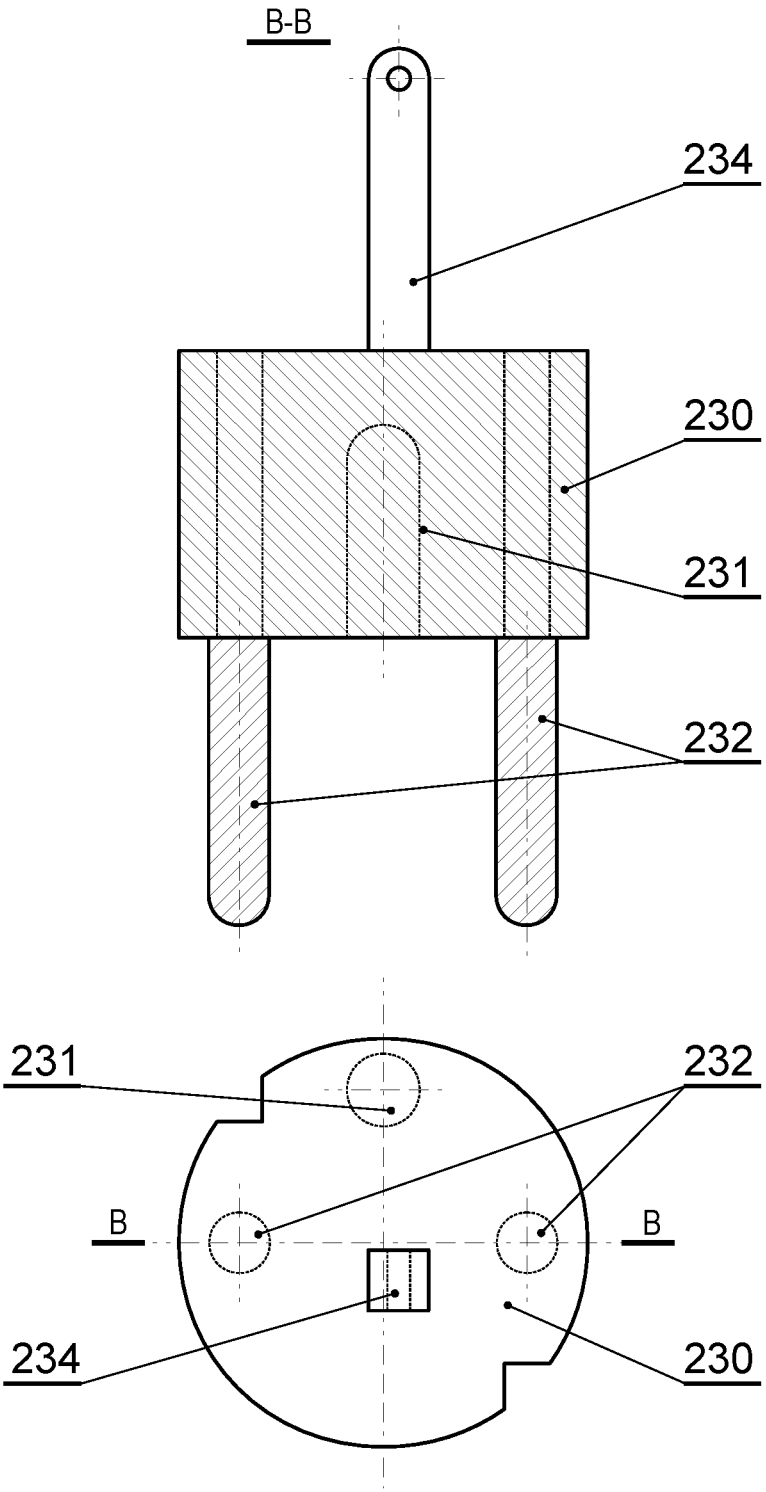
FIG. 6B shows a second top view of the core having pins as well as the core's B-B cross-section.

FIG. 6B shows a second top view of the inner core (230) as well as the core's B-B cross-section wherein the rod (234) is fixed to the inner core (230).

Figure 6C:
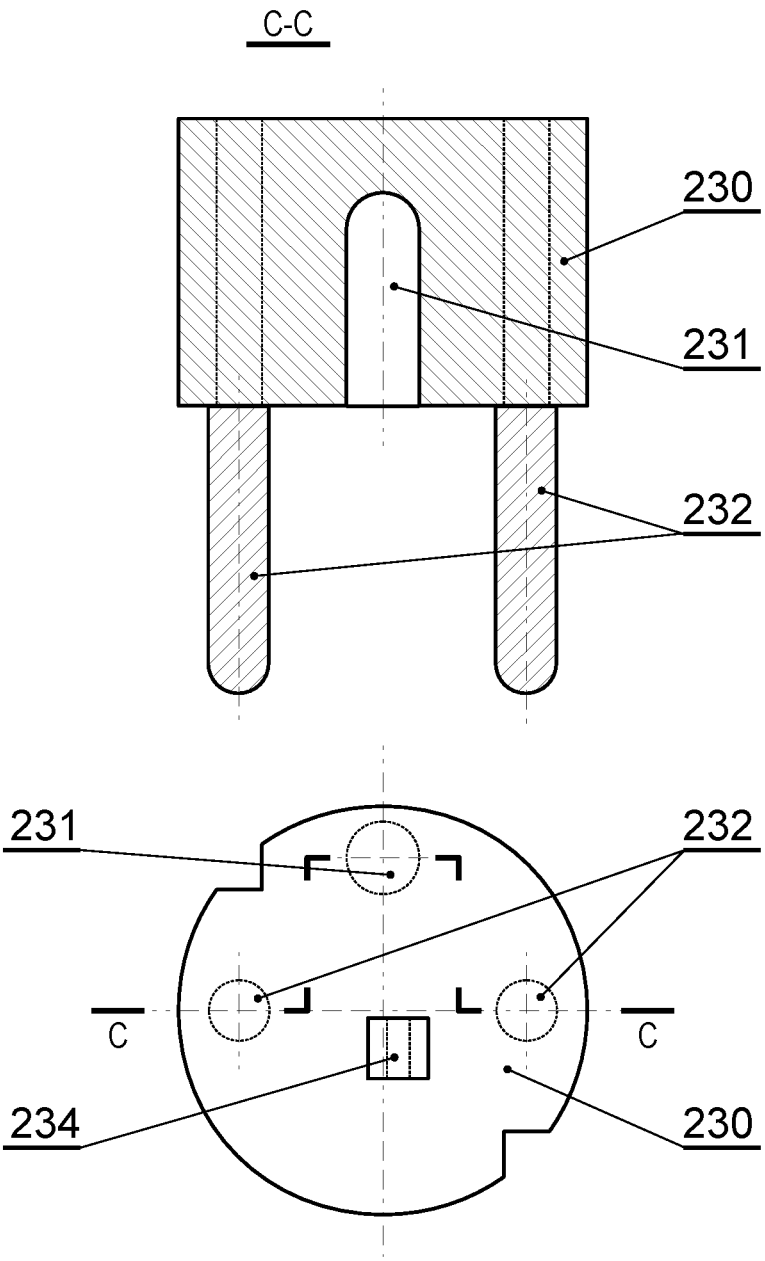
FIG. 6C depicts a third top view of the core having pins as well as the core's C-C cross-section.

Lastly, FIG. 6C presents a third top view of the inner core (230) having pins as well as the core's C-C cross-section. In this cross-section the optional, ground contact has been shown as a contact positioned away from a line crossing the main pins (232).

Figure 7:
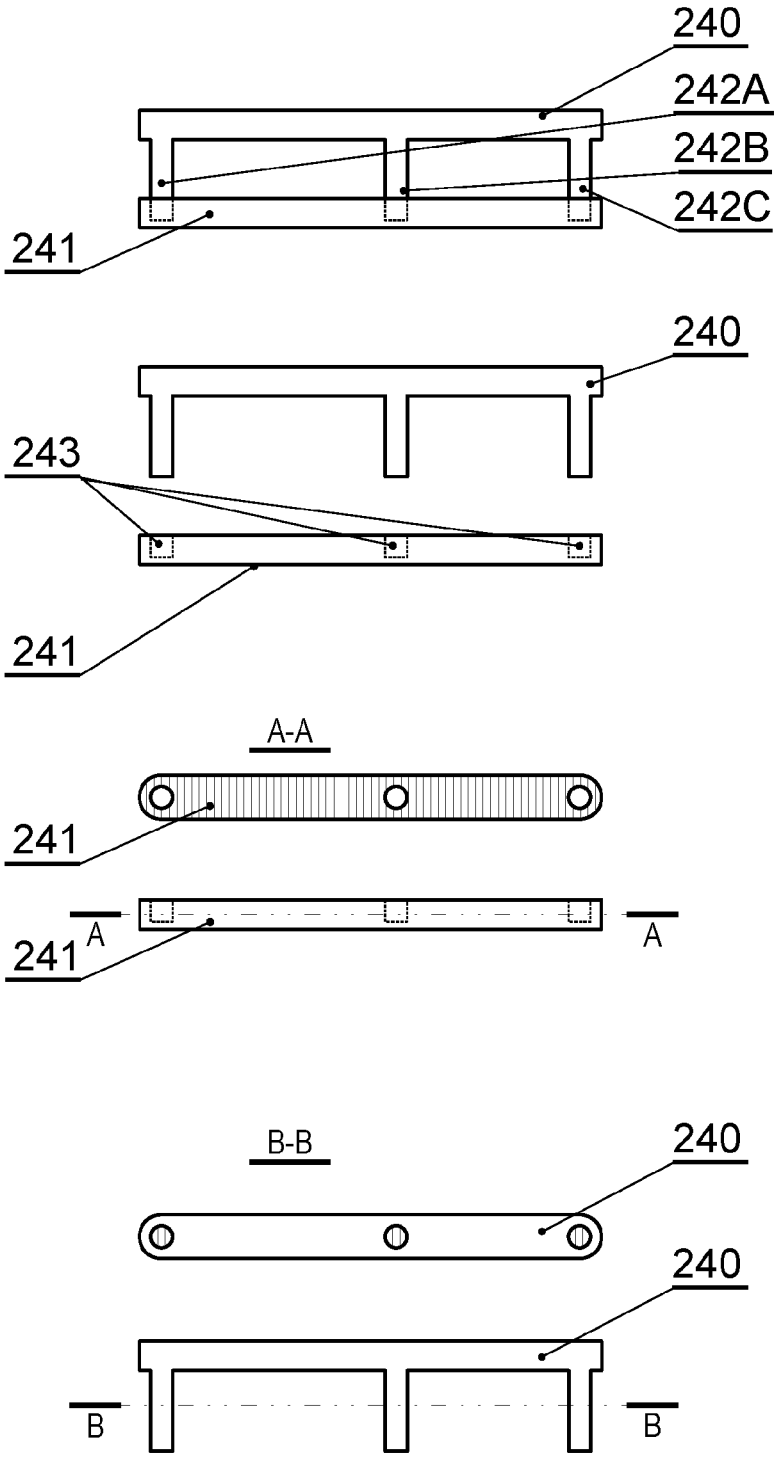
FIG. 7 presents a disassembled as well as assembled lever and its cross-sections.

FIG. 7 presents a disassembled as well as assembled lever (240) and its cross-sections. The lever (240) comprises three mounting elements (242A) left, middle (242B) and right (242C). As already explained, the middle mounting element (242B) is shifted from the center of the lever (240) towards one of its ends. In this case towards the right end. The mounting elements (242A-242C) may be in a form of pins.

The lever arrangement comprises also the lever lock (241) configured to receive and retain the mounting elements (242A-242C) (eg. a snap-on connection). To this end, the lever lock (241) may comprise suitable recesses (243).

It is to be noted that the lever (240) is to be locked (241) on the first bracket (211), on the rod (234) and on the second bracket (221). The left mounting element (242A), when mounted on the first bracket (211), slidably moves in the elongated opening (402). Similarly, the right mounting element (242C), when mounted on the second bracket (221), slidably moves in the elongated opening (503).

In other words, a fixedly mounted first bracket (211) is configured to guide a first end of the lever (240), while a fixedly mounted second bracket (221) is configured to guide a second end of the lever (240).

The left mounting element (242A) is preferably present at the far end of the lever (240), furthest from the middle mounting element (242B). The right mounting element (242C) is preferably present, at the other far end of the lever (240) closer to the middle mounting element (242B) than the left mounting element (242A) as shown in FIG. 7.

Figure 8:
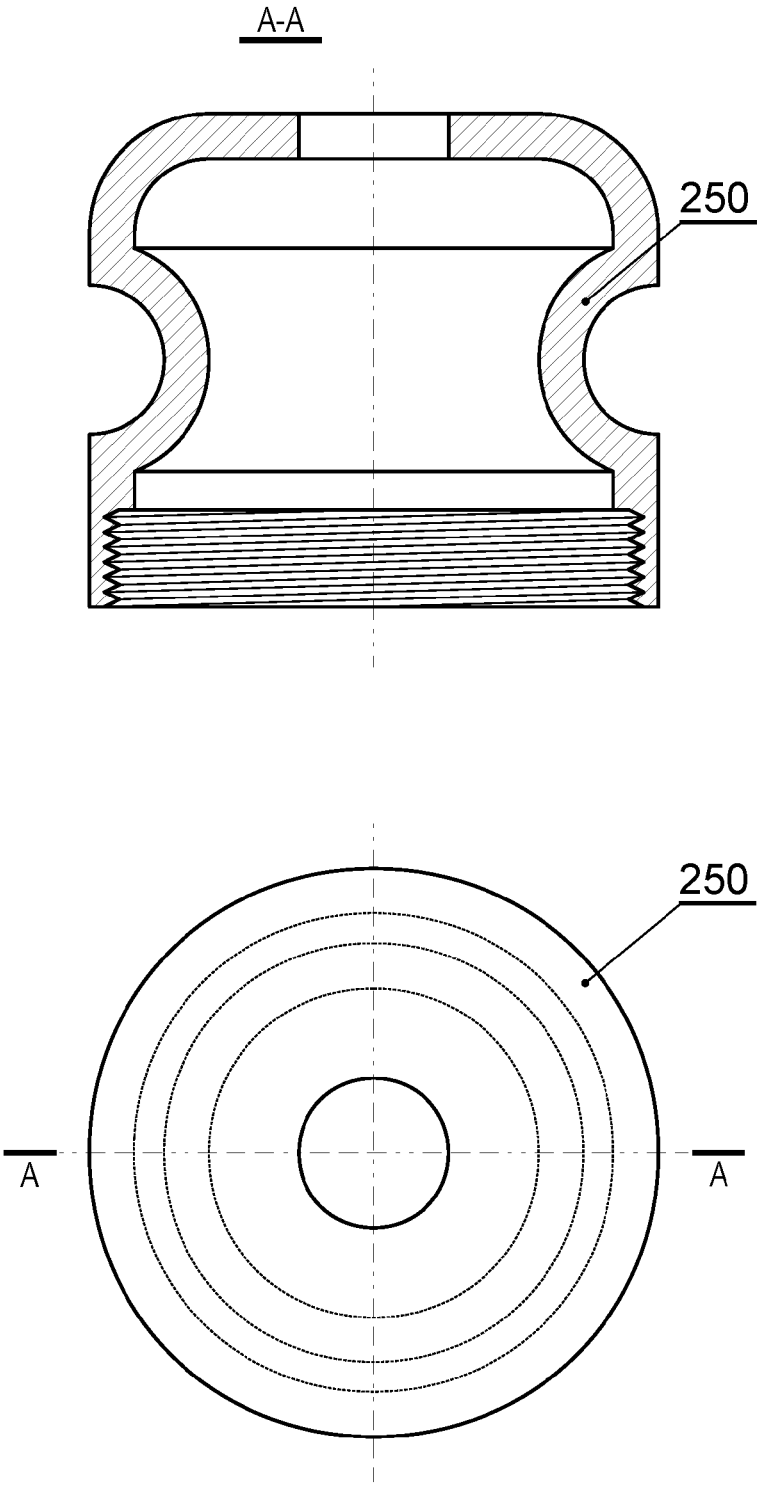
FIG. 8 shows a top view of the plug's housing cap and its cross-section.

FIG. 8 shows a top view of the plug's housing cap (250) and its cross-section. The cap (250) engages the housing (210) in any suitable way such as a threaded screw arrangements shown in the figure.

Figure 9A:
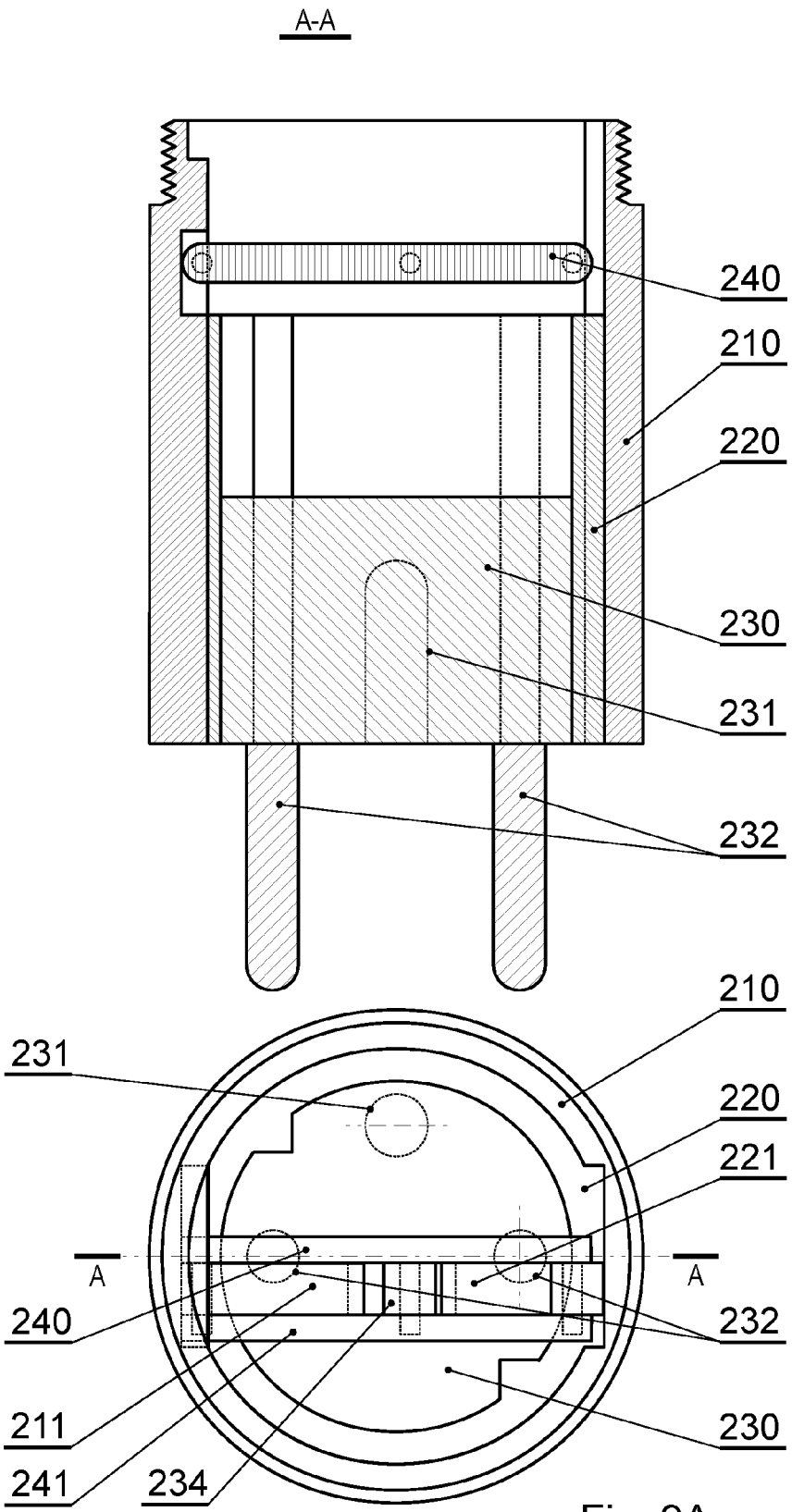
FIG. 9A depicts o first view of a partially assembled plug as well as its cross section.

FIG. 9A depicts o first view of a partially assembled plug as well as its cross section. All the elements shown have been previously described.

Figure 9B:
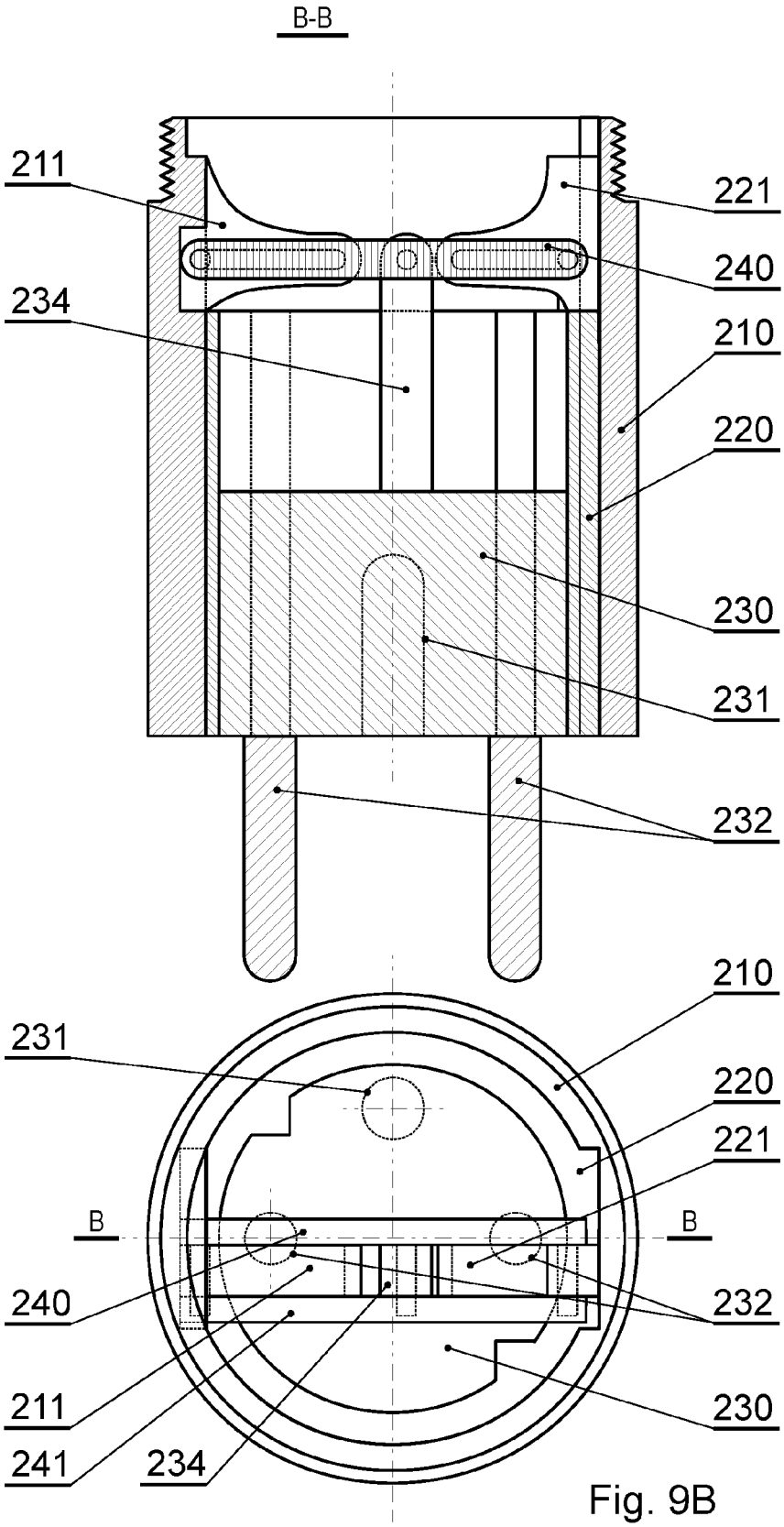
FIG. 9B presents an assembled plug without the cap as well as its cross-section.

FIG. 9B presents an assembled plug without the cap as well as its cross-section. This view comprises the lever (240) locked (241) on the first bracket (211), on the rod (234) and on the second bracket (221).

Figure 10:
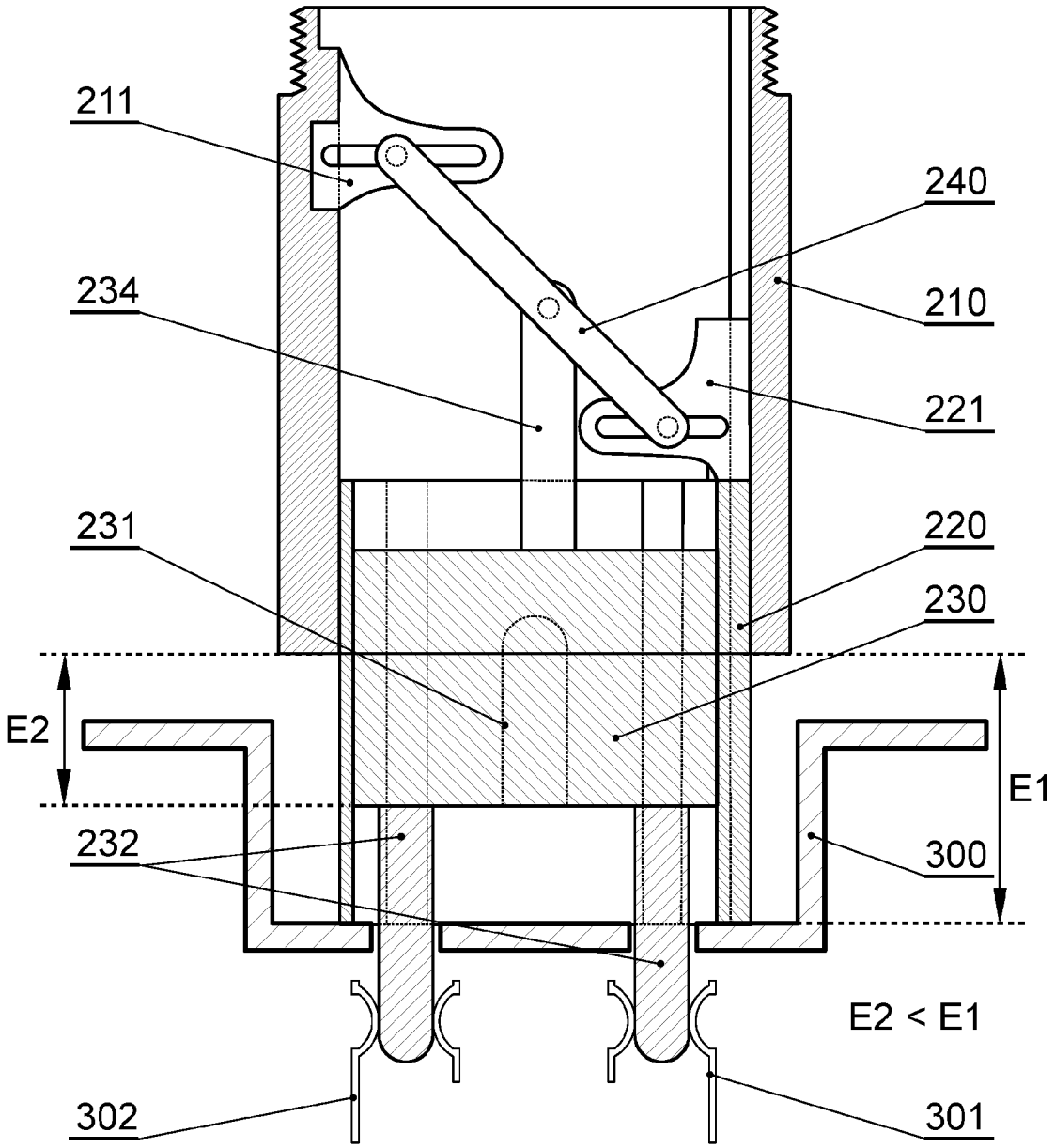
FIG. 10 shows a first cross-section of the assembled plug during an ejecting process.

FIG. 10 shows a first cross-section of the assembled plug during an ejecting process from a socket. As can be seen, a user pulls the housing (210)—this may be effected via the cap (250). While pulling the housing, the lever (240) pushes the ejector (220) against the socket's wall. At the same time, the inner core (230) withdraws, by means of the lever (240) and the rod (234), from the contacts (301, 302) into the ejector (220). Thus, the socket is not pulled from its mounting in a wall.

Figure 11:
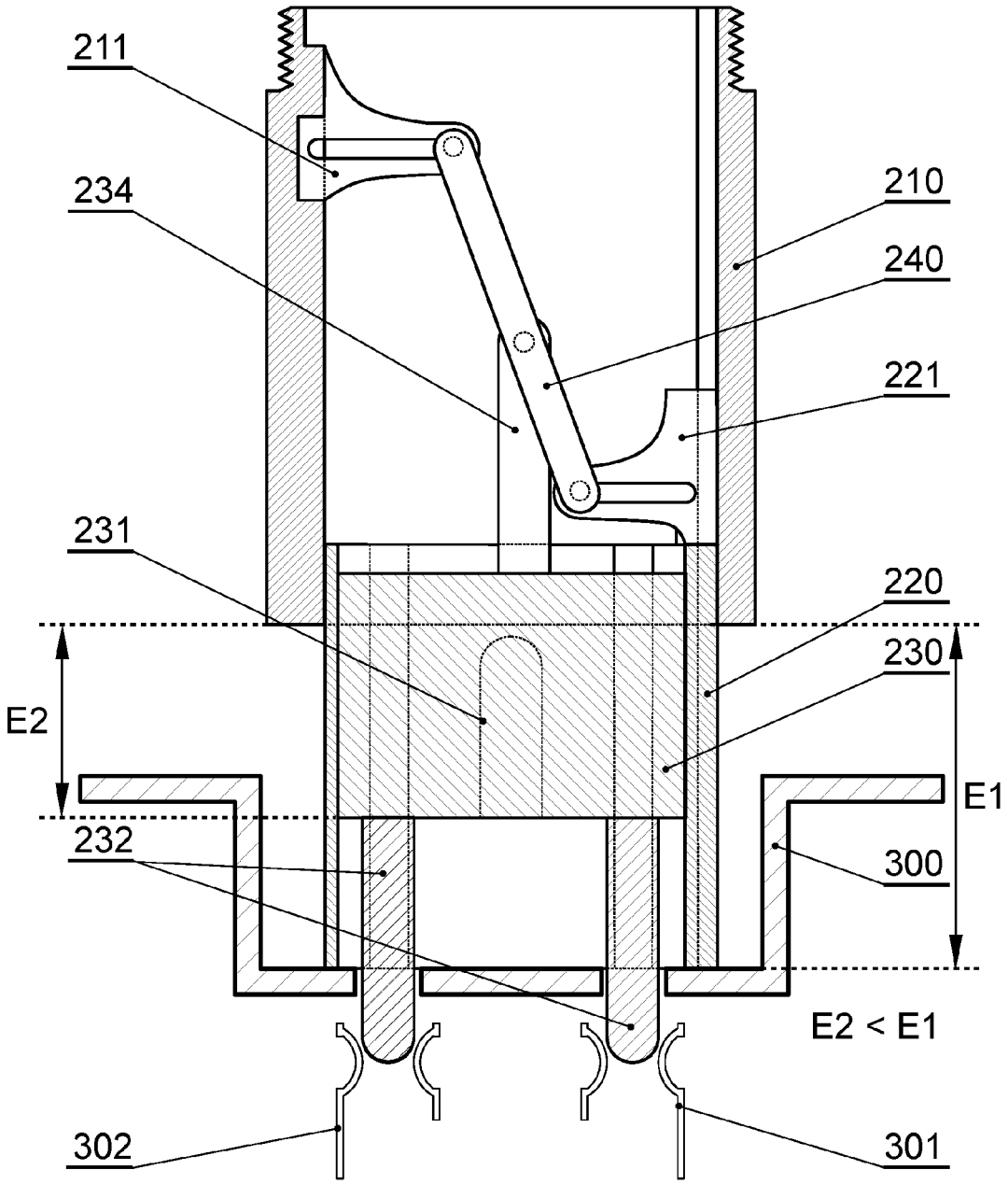
FIG. 11 presents a second cross-section of the assembled plug during the ejecting process.

FIG. 11 presents a second cross-section of the assembled plug during the ejecting process. When the left and right mounting elements (242A, 242C respectively) arrive at the ends of the elongated openings (420, 503) respectively, the pins (232) of the inner core (230) are almost loose at the contacts (301, 302) and the plug may be easily removed. At that time the lever (240) is at a position as close as possible to being parallel to the pins (232).

After unplugging, the inner core (230) and the ejector (220) may easily be slidably pushed into the housing (210). This will also happen when the pug is again plugged into a socket.

There is thus provided, by the present invention, a, improved plug, which is adapted to be connected to a socket in a typical manner but to be easily and efficiently disconnected therefrom by mechanical means.

The present invention may be adapted to a wide range of electrical connectors including, but not limited to: standard household plug and sockets, parallel connectors, serial connectors, and inline connectors. Advantageously, the present invention is suitable for any connectors, requiring considerable force to unplug, for example an audio/video SCART connector (CENELEC document number EN 50049-1).

While the invention presented herein has been depicted, described, and has been defined with reference to particular preferred embodiments, such references and examples of implementation in the foregoing specification do not imply any limitation on the invention. It will, however, be evident that various modifications and changes may be made thereto without departing from the broader scope of the technical concept.

The presented preferred embodiments are exemplary only, and are not exhaustive of the scope of the technical concept presented herein.

Accordingly, the scope of protection is not limited to the preferred embodiments described in the specification, but is only limited by the claims that follow.

The invention claimed is:

1. A plug comprising:

a housing (210);

an ejector (220);

an inner core (230) comprising at least two pins (232);

the plug being characterized in that:

the inner core (230) is slidably mounted within the ejector (220) while the ejector (220) is slidably mounted in the housing (210);

the housing (210) comprises a fixedly mounted first bracket (211) configured to guide a first end of a lever (240);

the ejector (220) comprises a fixedly mounted second bracket (221) configured to guide a second end of the lever (240);

the lever (240) has a middle mounting element (242B), located between the first end of the lever (240) and the second end of the lever (240), configured to guide a rod (243) attached to the inner core (230);

wherein the lever (240) is configured within the housing (210) such that when the ejector (220) slides out of the housing (210) to a first extent (E1), due to the movement of the lever (240), the inner core (230) slides within the ejector (220) to a second extent (E2), which is lower than the first extent (E1); and wherein the mechanical advantage of the lever is greater than 1 (105, 108, 107).

2. The plug according to claim 1, characterized in that the middle mounting element (242B) is shifted from the center of the lever (240) towards one of its ends.

3. The plug according to claim 1, characterized in that the at least two pins (232) are male pins and in that the inner core (230) comprises a third female pin (231).

4. The plug according to claim 1, characterized in that the mounting positions of the first (211) and second (221) brackets and the size of the ejector (220) are such that when the plug's pins (232) are fully inserted in socket's contacts, the lever (240) is perpendicular to the plug's pins (232).

5. The plug according to claim 1, characterized in that the first bracket (211) is fixedly mounted to the housing (210) at a fixed position and the second bracket (221) is fixedly mounted to the ejector (220) such that it moves slidably with it.

6. The plug according to claim 1, characterized in that the inner core (230) is slidably mounted within the ejector (220) in at least one guide (235) preventing the inner core (230) from rotatably moving within the ejector (220).

7. The plug according to claim 1, characterized in that the plug comprises a threaded portion (213) for mounting a plug's cap (250) comprising an opening for receiving an electrical cord.

8. The plug according to claim 1, characterized in that the housing (210) and the ejector (220) as well as the inner core (230) and the ejector (220) are in proximity to each other so that there is avoided side shake and there is allowed a gap between these elements is in the range allowing for a clearance fit.

9. The plug according to claim 1, characterized in that the rod (234), the lever (240), and the brackets (211, 221) are made from a rigid material.

10. The plug according to claim 1, characterized in that the lever (240) is connected to a lever lock (241) such that the locked lever is mounted to the first bracket (211), the second bracket (221) and the rod (234).

11. The plug according to claim 1, characterized in that the first bracket (211) and the second bracket (221) comprise an elongated opening (402, 503), extending perpendicularly to the plug's pins (232).

* * * * *